US005427550A

United States Patent [19]

Jaag

[11] Patent Number: 5,427,550

[45] Date of Patent: Jun. 27, 1995

[54] MULTI-TERMINAL CONNECTOR BLOCK

[75] Inventor: Dieter Jaag, Villingen-Schwenningen, Germany

[73] Assignee: RIA Electronic, Blumberg, Germany

[21] Appl. No.: 108,804

[22] Filed: Aug. 19, 1993

[30] Foreign Application Priority Data

Aug. 22, 1992 [DE] Germany ..... 9211314 U

[51] Int. Cl.[6] ..... H01R 9/22

[52] U.S. Cl. ..... 439/709; 439/727

[58] Field of Search ..... 439/79, 709, 712, 715, 439/719, 723, 724, 725, 727, 728

[56] References Cited

U.S. PATENT DOCUMENTS

| | | | |
|---|---|---|---|
| 1,023,326 | 4/1912 | Murray | 439/709 X |
| 2,991,440 | 7/1961 | Kulka | 439/709 X |
| 3,165,372 | 1/1965 | Jacobs et al. | 439/709 |
| 3,904,266 | 9/1975 | Fitzpatrick | 439/709 X |

FOREIGN PATENT DOCUMENTS 9000398 1/1990 Germany .

*Primary Examiner*—Khiem Nguyen
*Attorney, Agent, or Firm*—Eugene E. Renz, Jr.

[57] ABSTRACT

Multi-terminal connector assembly comprising a housing made of plastic, a first row of terminals insertable side-by-side into the housing for the introduction and connection of lead wires and a second row of terminal insertable side-by-side into the housing. The second row of terminals is arranged in a stair-like manner above and behind the row in the direction of insertion. Terminal pins are provided for the terminals, projecting from the base of the housing in two rows offset from each other in the insertion direction. The housing having a base parallel to the rows of terminals and to the insertion direction. The housing is designed as a single piece whereby the terminals of the first row can be introduced into the housing from the front in the insertion direction and wherein the terminals of the second row can be introduced into the housing from the rear in the direction opposite to the insertion direction. The terminal pins of the terminals of the second row are held in position in terminal holders of the housing.

4 Claims, 5 Drawing Sheets

MULTI-TERMINAL CONNECTOR BLOCK

FIELD OF THE INVENTION

The present invention relates to improvements in multi-terminal connector block assemblies.

BACKGROUND OF THE INVENTION

Multi-terminal connector blocks of the type to which the present invention relates are not new per se. Terminal block assemblies are usually used to connect circuit boards and in these applications, the base of the terminal block housing is placed on the circuit board and the terminal pins extending from the base are inserted into complementary openings in the circuit board and soldered in place. In some of these block assemblies, the first row of terminals is located directly above the base so that the terminal pins do not need to be very long. However, the second row of terminals is located at a predetermined height above the circuit board, usually at a distance corresponding to the height of the first row. Consequently, the terminal pins of the second row must be long enough to establish the connecting link between the circuit board and the terminals of the second row.

An example of a prior art block assembly is shown in German Registered Design 90-15,744 wherein the binding posts are arranged in two rows of terminals which are offset like stairs in order to conserve space. In accordance with the design shown in this German Registered Design, each row of terminals has its own separate housing and the housing of the two rows are of identical design. The terminals are inserted into the housing from the front in the feed direction of the lead wires. The housing for the second row of terminals is seated on a spacer block which is located behind the housing of the first row as viewed from the insertion direction and which supports the housing of the second row. The terminal pins of the terminals of the second row are inserted through holes in the spacer block so that the spacer block holds and positions the terminal pins.

One of the shortcomings of this prior art arrangement is that the additional spacer block means that the terminal block requires the use of many materials. Further, the need for two separate housings, one for each row of terminal blocks and the use of the additional spacer blocks compounds the complexity in terms of assembly of this prior art terminal block.

Other objects will appear hereinafter.

SUMMARY OF THE INVENTION

With the foregoing in mind, it is an object of the present invention to provide a multi-terminal connector block assembly characterized by novel features of construction and arrangement including two stair-like rows of terminals which require only a small amount of material and are very easy and economical to manufacture and assemble. The present invention comprises a housing made of plastic, a first row of terminal assemblies insertable side-by-side into the housing for the introduction and connection of lead wires, a second row of terminals insertable side-by-side into the housing. The second row is arranged in a stair-like manner above and behind the first row in the direction of insertion. Terminal pins for the terminals project from the base of the housing in two rows offset from each other in the insertion direction. The housings have a base parallel to the rows of terminals and to the insertion direction. The housings are designed as a single piece. Accordingly, the terminals of the first row can be introduced into the housing from the rear in a direction opposite to the insertion direction and the terminal pins of the terminals of the second row are held in position in terminal holders of the housing.

In accordance with other more specific features of the present invention, the terminal holders are formed by flexible tongues connected to the housing which project into the open space in the insertion direction. Further, the tongues are flush with the base surface of the housing and each pair forms a receiving slot having a width less in diameter than the diameter of the terminal pins including a latching receptacle in the receiving slot for holding the terminal pin in position.

The terminal block of the present invention has various advantageous over the prior art. For example, the invention is relatively simple and only requires a single one-piece housing. This obviates the need for additional measures to hold in position the housing component which receives the terminals of the second row. In accordance with the present invention, the terminals of the first row are inserted into the housing from the front in the feed direction of the lead wires. However, the terminals of the second row are inserted into the housing in the opposite direction. To make it possible to insert the terminals therefore, there is no need to separate the housing into two components one to hold the first terminals and the other to hold the second terminals. To accommodate assembly and securing of the upper second row of terminals, the housing is provided with terminal receptacles which hold the terminal pins in place when the terminals are being inserted. Since the terminal receptacles are formed as an integral part of the housing, this obviates the needs for any superfluous additional measures for holding and positioning the terminal pins.

Accordingly, the terminal block of the present invention provides an improved construction over the prior art in a simple, one-piece housing which accommodates both rows of terminals wherein the terminal pins of the upper second row are held in place automatically. By reason of this construction, only a small amount of plastic material is required to produce the housing of the terminal block and the unit is much easier to assemble.

In accordance with another feature of the present invention, an especially low-cost design is obtained when the housing has an open space behind the first row and underneath the second row of terminals. This space is occupied only by flexible tongues which project into the space to serve as receptacles for the terminal pins of the second row. In this design variant, the flexible tongues are preferably located on the base surface of the housing and in this position are therefore the greatest possible distance away from the housing component which holds the upper row of terminals. By reason of this configuration, the terminal pins are held in place with an especially high degree of stability. Moreover, in accordance with this design, the terminal pins are positioned directly on the base surface so that they are aligned precisely with respect to the contact holes of the circuit board.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
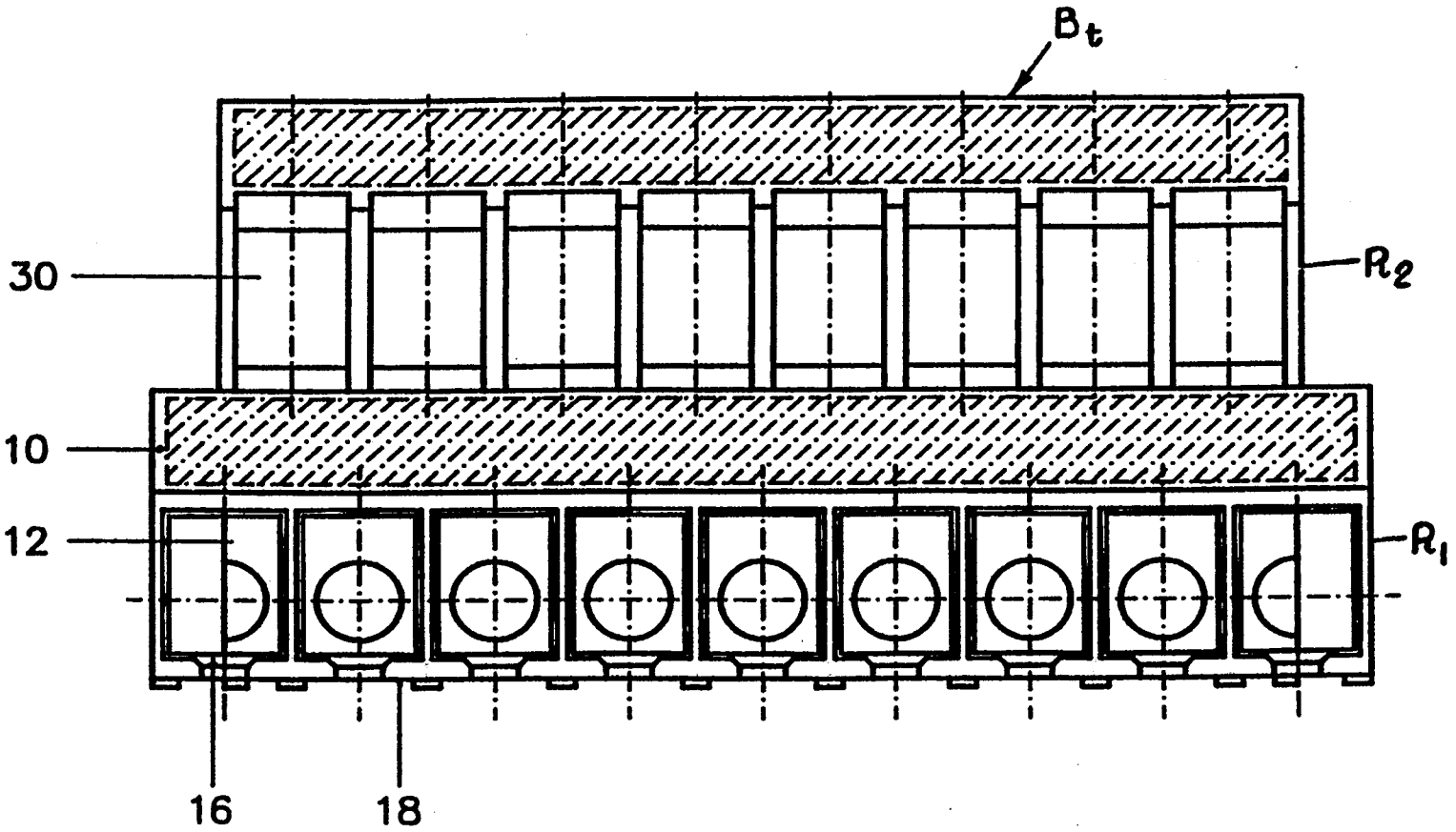
FIG. 1 is a front elevational view of the terminal block housing.
Figure 5:
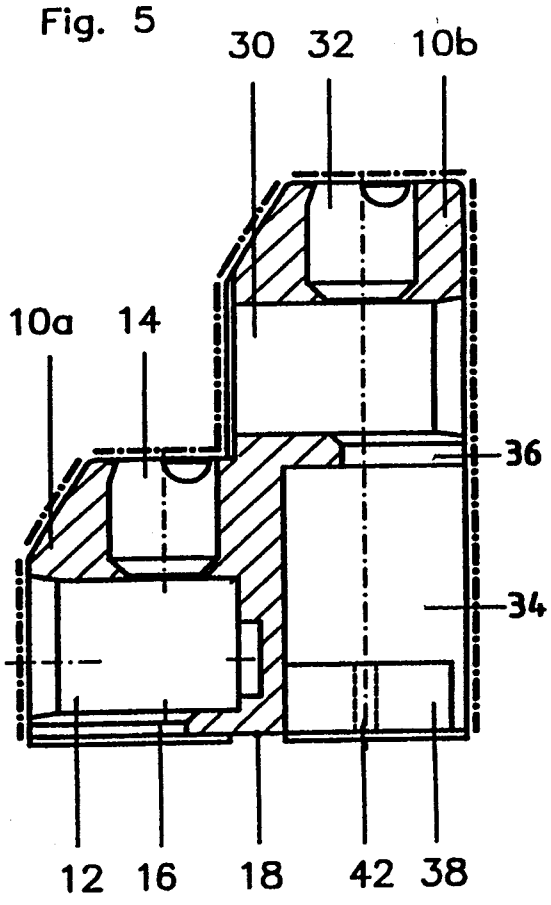
FIG. 5 is an enlarged sectional view through the housing taken on line 5—5 of FIG. 2.
Figure 2:
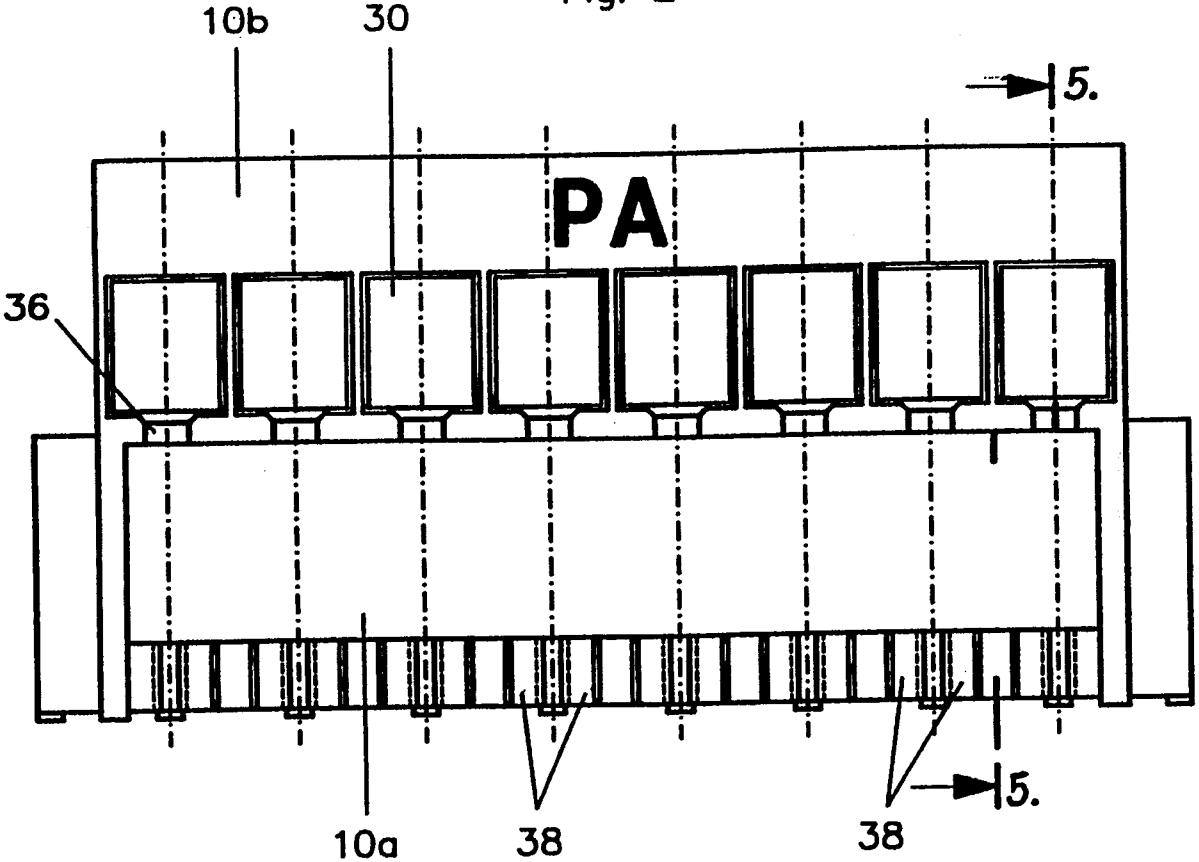
FIG. 2 is a rear elevational view of the terminal block housing.
Figure 3:
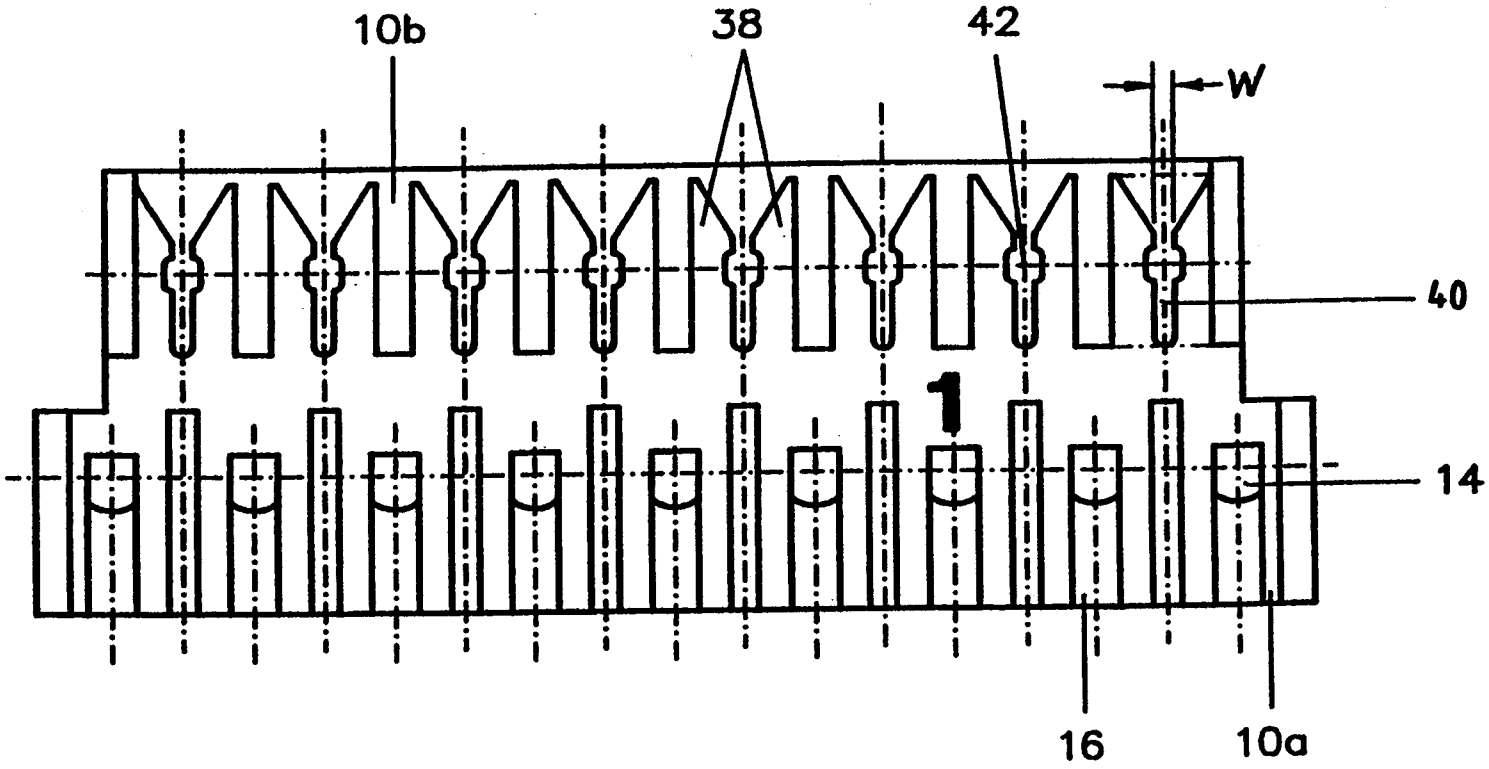
FIG. 3 shows a view of the housing from below.
Figure 4:
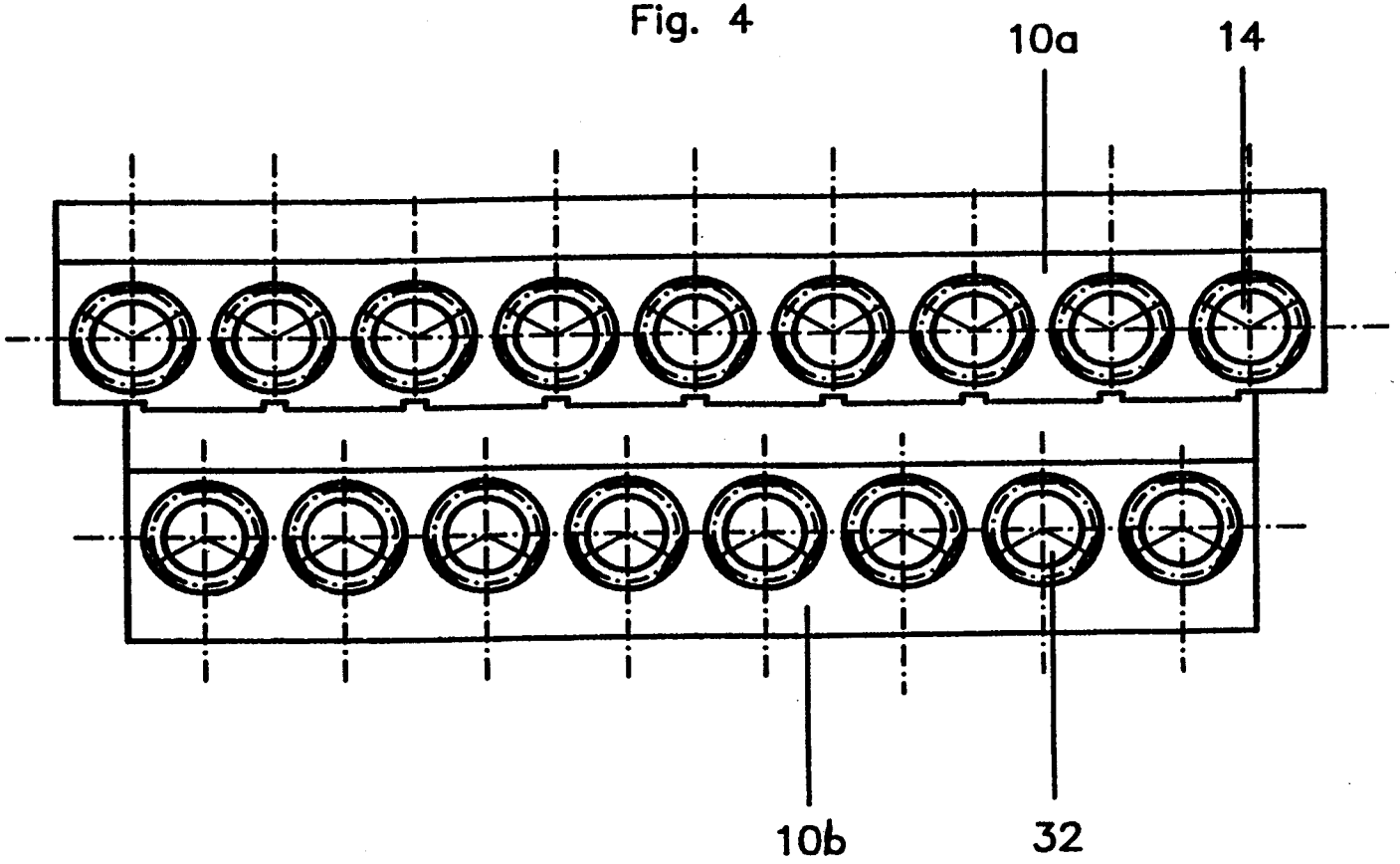
FIG. 4 shows a view of the housing from above.
Figure 7:
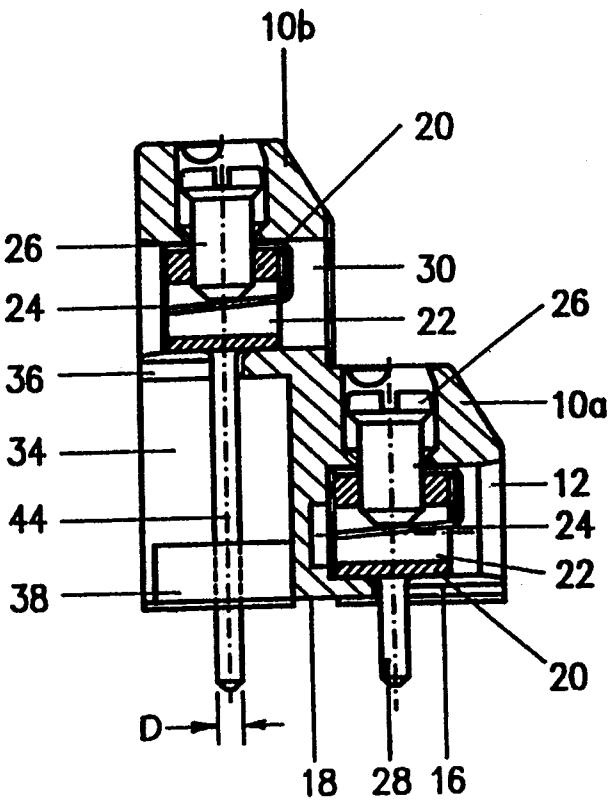
FIG. 7 is an enlarged cross-sectional view through the terminal block taken on line 7—7 of FIG. 6.
Figure 6:
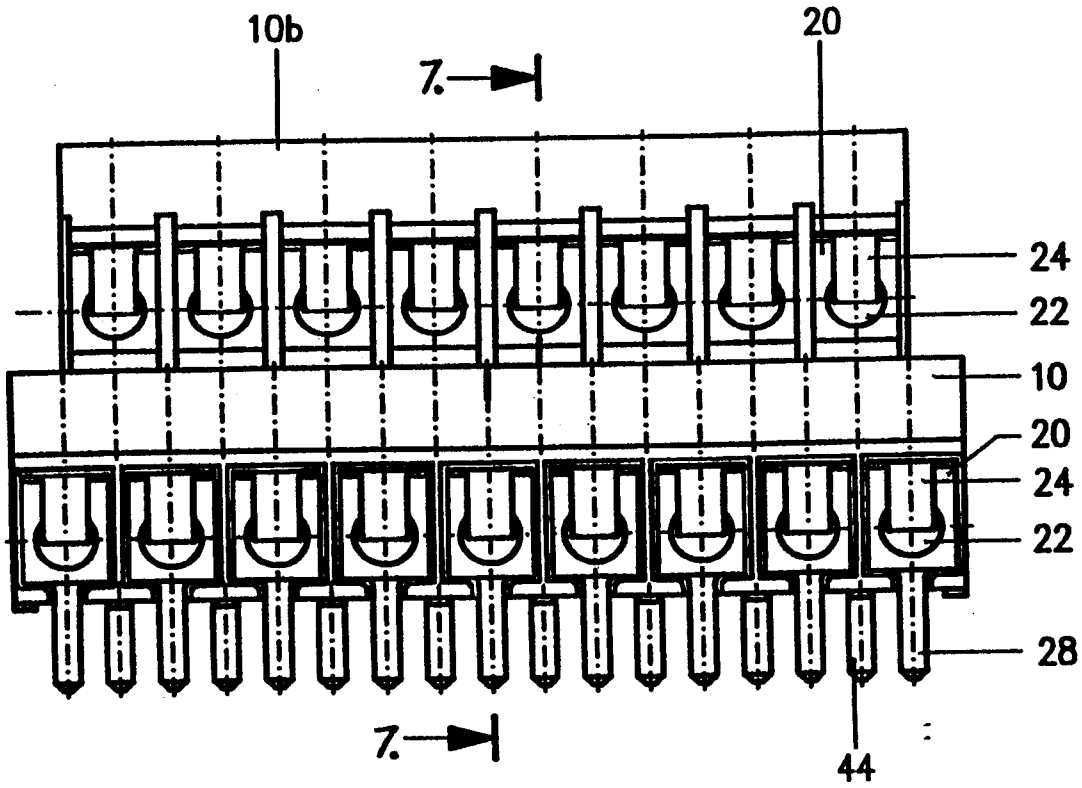
FIG. 6 is a front elevational view of the complete terminal block shown in FIG. 1.

Referring now to the drawings and particularly to FIGS. 1, 2 and 7 thereof, there is shown a terminal block constructed in accordance with the present invention generally designated $B_t$. The terminal block $B_t$ as illustrated, includes a first side-by-side row $R_1$ of nine terminals and a second side-by-side row $R_2$ of eight terminals. The second row $R_2$ of terminals is offset with respect to the first row $R_1$ in a stair-like pattern or array. The terminal block $B_t$ is utilized in circuit boards and the like to make electrical connections therewith. The terminal pins 28 and 44 are inserted into holes in the circuit board and soldered to the circuit pathways.

Considering now the details of the terminal block $B_t$ more specifically, the terminal block $B_t$ comprises a housing 10 made of plastic which is molded as a single piece and consists of two housing components, a first housing component $\mathbf{10}^a$ for the first row of terminals $R_1$ and a second housing component $\mathbf{10}^b$ for the second row of terminals $R_2$. The housing is of a stepped configuration so that the two housing components $\mathbf{10}^a$ and $\mathbf{10}^b$ are arranged like a pair of steps with the second housing component $\mathbf{10}^b$ offset to the rear and upwardly with the respect to the first housing component $\mathbf{10}^a$.

In the embodiment of the invention illustrated, the first housing component $\mathbf{10}^a$ has nine receptacles 12 arranged in a row side by side which are designed as blind holes facing the front. A connecting port 14 extends from the top of the housing component $\mathbf{10}^a$ into each receptacle 12. A slot 16 is provided in the bottom surface of receptacle 12 which extends in the axial direction and opens towards the front. Consequently, receptacles 12 are open at slot 16 along base surface 18 of housing 10.

Terminals to which lead wires can be connected are inserted into each receptacle 12 of first housing component $\mathbf{10}^a$. The terminals consist of a metal terminal body 20 with an insertion opening 22, a wire protector 24, and a locking screw 26, which is screwed into a threaded hole in terminal body 20. A terminal pin 28 is attached to the bottom of terminal body 20. Terminal body 20 of the terminal is inserted from the front into receptacle 12, and terminal pin 28 is able to slide through slot 16 and project from base surface 18 of housing 10. After the insertion of the terminal body 20 and wire protector 24, the locking screw 26 is inserted into an appropriate hole 14 and screwed into terminal body 20.

In second housing component $\mathbf{10}^b$, a row of eight side-by-side receptacles 30 is provided. Receptacles 30 extend all the way through the housing $\mathbf{10}^b$ in the insertion direction from front to back. From the top of second housing component $\mathbf{10}^b$, holes 32 lead vertically downward into receptacles 30. Behind the housing component $\mathbf{10}^a$ and underneath second housing component $\mathbf{10}^b$, housing 10 has an open space 34. Slots 36 are provided in the bottom of receptacles 30. These slots open toward the rear of housing 10. The slots 36 represent an opening which connects receptacles 30 to open space 34.

On the vertical back of first housing component $\mathbf{10}^a$, terminal holders are provided. Each terminal holder consists of a pair of elastic tongues 38, injection-molded as an integral part of housing component $\mathbf{10}^a$. Flexible tongues 38 project perpendicularly from the back wall of first housing component $\mathbf{10}^a$ into free space 34 and are flush with base surface 18 of housing 10. Each pair of flexible tongues 38 defines a receiving slot 40, which, in a vertical projection, coincides with slot 36 in receptacle 30. Receiving slots 40 are open toward the back of said housing 10 and expand like funnels at their open end. Underneath the inside end of said slots 36, as seen in the vertical projection, each receiving slot 40 has an expanded latching receptacle 42.

Terminals which are similar to the terminals of the first row but which have a longer pin 44, are inserted into receptacles 30 of second housing component $\mathbf{10}^b$. Terminal bodies 20 of the terminals of the second row are introduced from the rear of second housing component $\mathbf{10}^b$ into receptacles 30, while terminal pins 44 pass through slots 36 and project into open space 34. When terminal bodies 20 are inserted into receptacles 30, the free bottom ends of terminal pins 44 arrive in receiving slots 40 formed by flexible tongues 38. When terminal bodies have been inserted all the way and have reached their final position, i.e., the position in which terminal pins 44 are resting against the inner end of slots 36, the lower ends of terminal pins 44 will have arrived in the associated latching receptacle 42 of receiving slot 40 formed by flexible tongues 38. The diameter D of terminal pins 44 is slightly larger than the width W of receiving slot 40, so that, as terminal pins 44 are being introduced into receiving slots 40, they spread elastic tongues 38 slightly apart until terminal pins 44 arrive in expanded latching receptacles 42. The width W of the latching receptacle 42 corresponds to the diameter D of the terminal pins 44, so that the terminal pins 44 are held in the proper position in the latching receptacles and flexible tongues 38 spring back into their untensioned position. Terminal pins 44 are long enough to project beyond base surface 18 of housing 10 formed by flexible tongues 38 by the same distance that terminal pins 28 of the terminals of first row project. After terminal bodies 20 have reached their final position, locking screws 26 are inserted from above through holes 32. These locking screws pass through wire protector 24 and are screwed into the threaded hole in terminal body 20.

Lead wires can be introduced from the front into insertion opening 22 of terminal bodies 20 of the terminals of the first and second row and clamped firmly in place by locking screws 26 and wire protectors 24. Base surface 18 of the terminal block is placed on the circuit board. Terminal pins 28, 44 are guided through holes in the circuit board and soldered to circuit pathways of the circuit board. In the exemplary embodiment shown, the eight terminals of the second row $R_2$ are shifted by half a spacing unit with respect to the nine terminals of the first row $R_1$, so that terminal pins 28, 44 project in a zigzag pattern from base surface 18. As a result, the distance between terminal pins 28 and terminal pins 44 is increased, and a longer creep distance is obtained.

Even though a particular embodiment of the present invention has been illustrated and described herein it is not intended to limit the invention and changes and modifications may be made therein with the scope of the following claims.

What is claimed is:

1. Multi-terminal connector assembly comprising:

a housing having a base;

a first row of terminals insertable side-by-side into the housing for the introduction and connection of lead wires;

a second row of terminals insertable side-by-side into the housing;

said second row being arranged in a stair-like manner above and behind said first row in a direction of wire insertion;

terminal pins for the terminals, projecting from the base of the housing in two rows offset from each other in the wire insertion direction;

said housing having a base parallel to the rows of terminal and to the wire insertion direction;

said housing (10) being designed as a single piece, whereby the terminals (20, 22, 24, 26, 28) of the first row can be introduced into the housing (10$^a$) from the front in the wire insertion direction and the terminals (20, 22, 24, 26, 44) of the second row can be introduced into the housing (10$^b$) from the rear in the direction opposite to the wire insertion direction;

said terminal pins (44) of the terminals of the second row being held in position in terminal holders (38, 40, 42) of the housing (10);

said housing (10) having an open space (34) located behind the first row of terminals (20, 22, 24, 26, 28), in the wire insertion direction, and under the second row of terminals (20, 22, 24, 26, 44); and wherein the terminal holders are formed by flexible tongues (38) connected to the housing (10), which project into the open space (34) in the insertion direction.

2. Multi-terminal connector assembly according to claim 1, characterized in that the flexible tongues (38) are flush with the base surface (18) of the housing (10).

3. Multi-terminal connector assembly according to claim 1, characterized in that each pair of elastic tongues (38) forms a receiving slot (40) having a width less than the diameter of the terminal pins (44), and including latching receptacle (42) in the receiving slot (40) for holding the terminal pin (44) in position.

4. A multi-terminal connector assembly comprising:

a first row of terminals insertable side-by-side into the housing for the introduction and connection of lead wires;

a second row of terminals insertable side-by-side into the housing, said second row being arranged in a stair-like manner above and behind said first row in the direction a wire insertion;

terminal pins for the terminals projecting from the base of the housing in two rows offset from each other in the wire insertion direction;

said housing (10) being designed as a single piece, and having a base parallel to the rows of terminal and to the wire insertion direction whereby the terminals (20, 22, 24, 26, 28) of the first row can be introduced into the housing (10$^a$) from the front in the wire insertion direction and the terminals (20, 22, 24, 26, 44) of the second row can be introduced into the housing (10$^b$) from the rear in the direction opposite to the wire insertion direction; and means defining an open space (34) in said housing (10$^a$) located behind the first row of terminals in the wire insertion direction, and under the second row of terminals whereby said terminal pins of the terminals of the second row project into said open space and are held in position in the open space by terminal holders of the housing.

* * * * *